US006598679B2

(12) United States Patent
Robertson

(10) Patent No.: US 6,598,679 B2
(45) Date of Patent: Jul. 29, 2003

(54) RADIAL CUTTING TORCH WITH MIXING CAVITY AND METHOD

(75) Inventor: Michael C. Robertson, Burleson, TX (US)

(73) Assignee: MCR Oil Tools Corporation, Burleson, TX (US)

( * ) Notice: Subject to any disclaimer, the term of this patent is extended or adjusted under 35 U.S.C. 154(b) by 0 days.

(21) Appl. No.: 09/955,686

(22) Filed: Sep. 19, 2001

(65) Prior Publication Data

US 2003/0051870 A1 Mar. 20, 2003

(51) Int. Cl.[7] ..... E21B 29/00
(52) U.S. Cl. ..... 166/297; 166/55.2
(58) Field of Search ..... 166/55, 55.2, 55.8, 166/297; 102/312, 313

(56) References Cited

U.S. PATENT DOCUMENTS 3,076,507 A * 2/1963 Sweetman ..... 166/55.2
3,713,636 A * 1/1973 Helms et al. ..... 102/335
4,298,063 A 11/1981 Regalbuto et al.
4,352,397 A * 10/1982 Christopher ..... 166/55
4,559,890 A * 12/1985 Regalbuto et al. ..... 114/230.1
4,598,769 A 7/1986 Robertson
5,435,394 A 7/1995 Robertson
6,186,226 B1 2/2001 Robertson

* cited by examiner

*Primary Examiner*—David Bagnell
*Assistant Examiner*—Matthew Smith
(74) *Attorney, Agent, or Firm*—Geoffrey A. Mantooth

(57) ABSTRACT

An apparatus is provided which is adapted to be located in a conduit to be severed. The apparatus includes an upper ignition device, combustible material and a lower nozzle with a diverter. In operation the ignition device is actuated to ignite the combustible material to form a flame of hot gases for passage through apertures of the nozzle to the diverter which directs the hot gases radially outward and against the conduit to be severed. A uniform mixing cavity is provided above the nozzle in the flow path of the flame to the nozzle for mixing the hot gases prior to passages through the nozzle. A lower cavity is provided for the hot gases flowing out of the nozzle for pressurizing the hot gases at the outlet of the apparatus.

16 Claims, 7 Drawing Sheets

RADIAL CUTTING TORCH WITH MIXING CAVITY AND METHOD

BACKGROUND OF THE INVENTION

1. Field of the Invention

The invention relates to an apparatus for cutting pipe in a borehole extending into the earth from the surface.

2. Description of the Prior Art

U.S. Pat. Nos. 4,298,063, 4,598,769, 5,435,394, and 6,186,226B1 disclose apparatus for cutting pipe in a borehole. U.S. Pat. Nos. 4,598,769 and 5,435,394 are incorporated into the application by reference. In U.S. Pat. Nos. 4,598,769 and 5,435,394, the apparatus comprises an elongated body to be located in the pipe. The body has a central opening extending between an upper ignition device and a lower nozzle. Solid combustible material is located in the opening. The nozzle has a plurality of spaced apart apertures extending therethrough angularly around the axis leading to a diverter. The diverter has a flared surface which curves outward from a small circumference near the nozzle to an enlarged annular circumference. In operation, the ignition device is actuated to ignite the combustible material to form a flame of hot gases for passage through the apertures of the nozzle to the curved surface. The surface directs the flame and hot gases radially outward, which moves a sleeve down and the flame outward against the pipe for severing purposes.

Although the apparatus severs a pipe, sometimes problems occur in that the apertures of the nozzle become clogged and/or the severing procedure is not uniform due to the concentration of heat points of the flame radially outward from the exits of the apertures of the nozzle.

SUMMARY OF THE INVENTION

It is an object of the invention to provide an apparatus which is an improvement to the apparatus of U.S. Pat. Nos. 4,598,769, and 5,435,394 in that it avoids the problems mentioned above.

The apparatus of this invention comprises a uniform mixing cavity above the nozzle in the flow path of the flame to the nozzle which allows the hot gases to mix and provides a more even distribution of the hot gases through the nozzle apertures to prevent the nozzle apertures from being plugged.

The invention also provides a lower mixing cavity for the hot gases flowing out of the nozzle which pressurizes the annular gap at the outlet of the curved surface of the diverter and more evenly distributes the outward flowing hot gases around the curved surface of the diverter to obtain a move even cutting of the pipe around its circumference.

DESCRIPTION OF THE PREFERRED EMBODIMENTS

Figure 1:
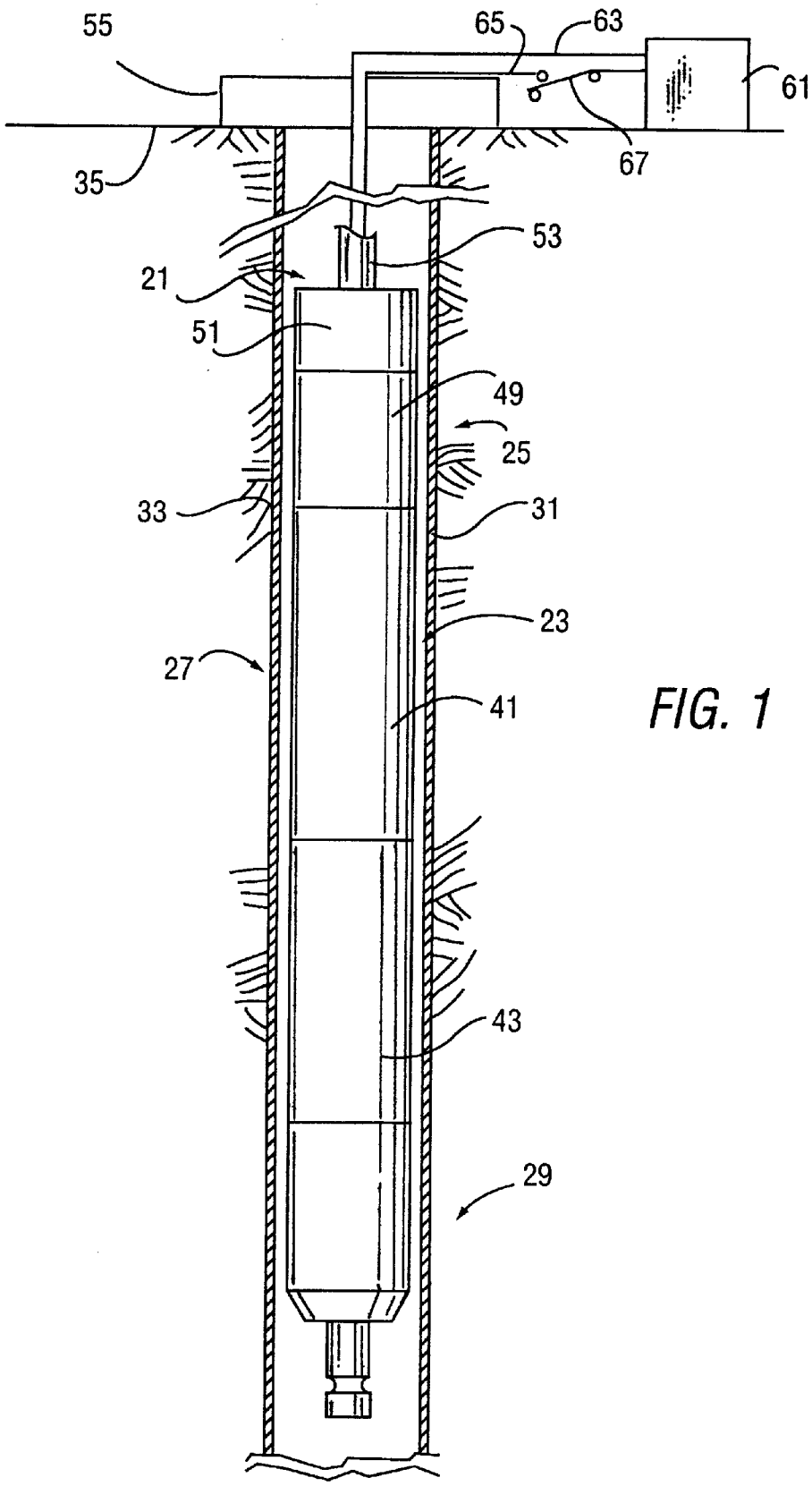
FIG. 1 illustrates the apparatus or tool of the invention in pipe located in a borehole extending from the surface.

Referring now to FIGS. 1, 2A, 2B, and 3 the apparatus or tool of the invention is identified at 21. It comprises an elongated tubular body 23 having an upper ignition end 25 which carries an ignition device, an intermediate section 27 which carries fuel pellets and a nozzle end 29. The tool 21 is adapted to be located in pipe 31 located in a borehole 33 extending into the earth from the surface 35 for severing the pipe. The pipe may be stuck in the borehole and it is desirable to sever the pipe above where it is stuck whereby the upper portion may be removed from the borehole. The pipe may be a drill pipe, production tubing, coiled tubing, casing, etc. The ignition device is actuated to ignite the fuel pellets to create a flame which is applied to a nozzle and diverter in the nozzle end 29 to direct the flame radially out of the tool against the pipe to sever or cut the pipe.

The body 23 comprises two hollow metal cylindrical members 41 and 43 having threads 41T1 and 43T which are screwed together and an upper hollow metal cylindrical member 49 having threads 49T which are screwed threads to 41T2 of member 41. A cable head assembly 51 is coupled to member 49 and a wireline cable 53 is coupled to the upper end of assembly 51 and extends to the surface 35 to apparatus 55 which includes a reel employed for unwinding and winding the cable 53 to lower and raise the apparatus 23. Also provided is an AC or DC source 61 of electrical power for applying electrical power to electrical leads 63 and 65 of the cable 53 when the switch 67 is closed.

The cylindrical members 41 and 43 have cylindrical openings 41(O) and 43(O) extending therethrough. Supported in the openings 41(O) and 43(O) are a plurality of stacked solid fuel pellets 71. The pellets 71 are formed of combustible pyrotechnic material which is pressed together into a pellet of a generally donut or torroid configuration having a central hole 73 formed therethrough. The holes 73 of the pellets 71 are aligned when the pellets 71 are stacked in the openings 41(O) and 43(O). Loose combustible material 75 which may be of the same material as that of the pellets 71 is disposed in the holes 73.

Figure 2A:
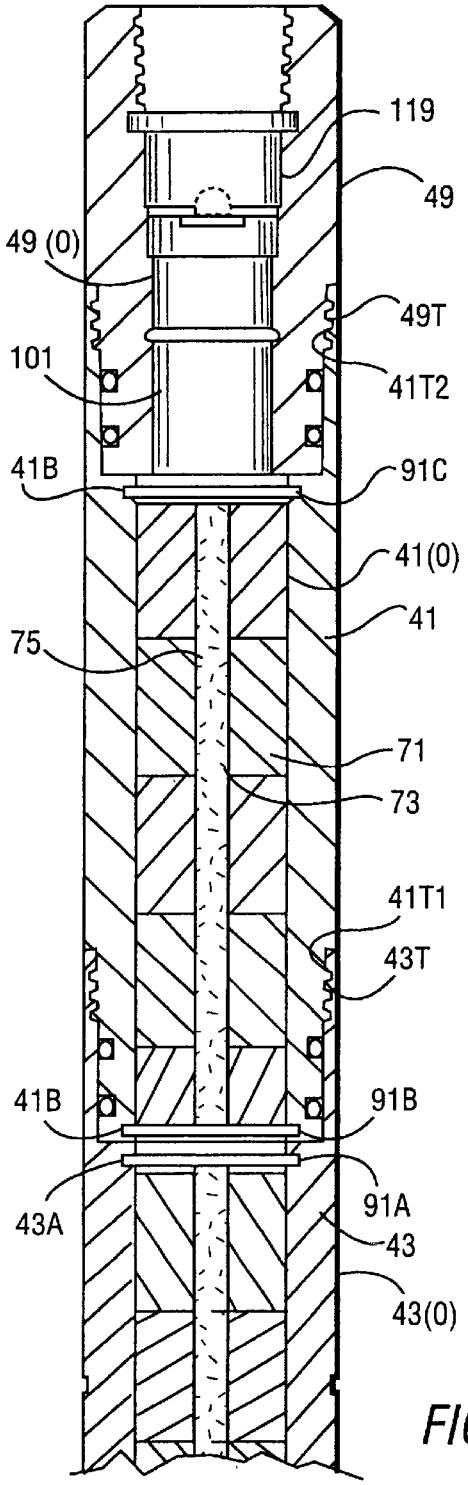
FIGS. 2A and 2B are partial sectional views of the pipe cutting apparatus of the invention. The upper end of the section of FIG. 2B is connected to the lower end of the section of FIG. 2A.
Figure 2B:
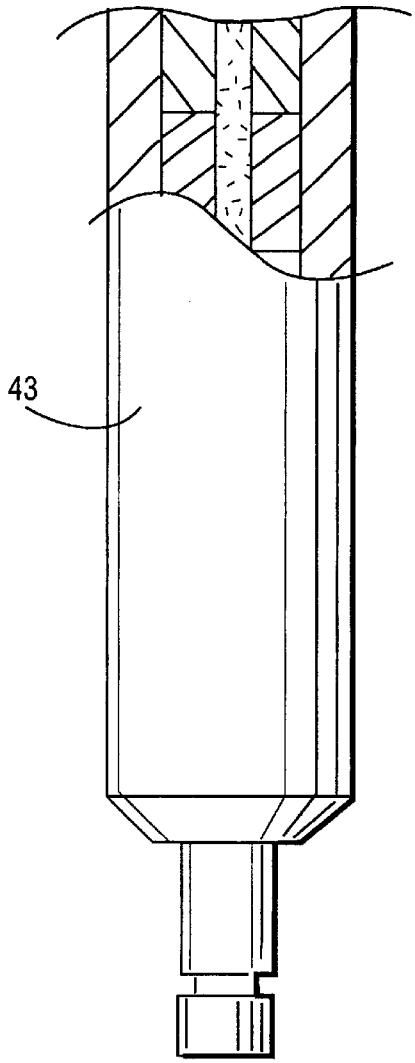

The pellets 71 are held between a lower support 81 and metal snap rings 91A, 91B, and 91C located in grooves 43A, 41A, 41B. The lower support 81 supports the pellets 71 when the tool is in a vertical position as shown in FIGS. 1, 2A, 2B and snap rings 91A, 91B, and 91C prevents the pellets from falling out of the tool in the event the tool is in a horizontal position or its end 25 is lower than end 29.

Figure 9:
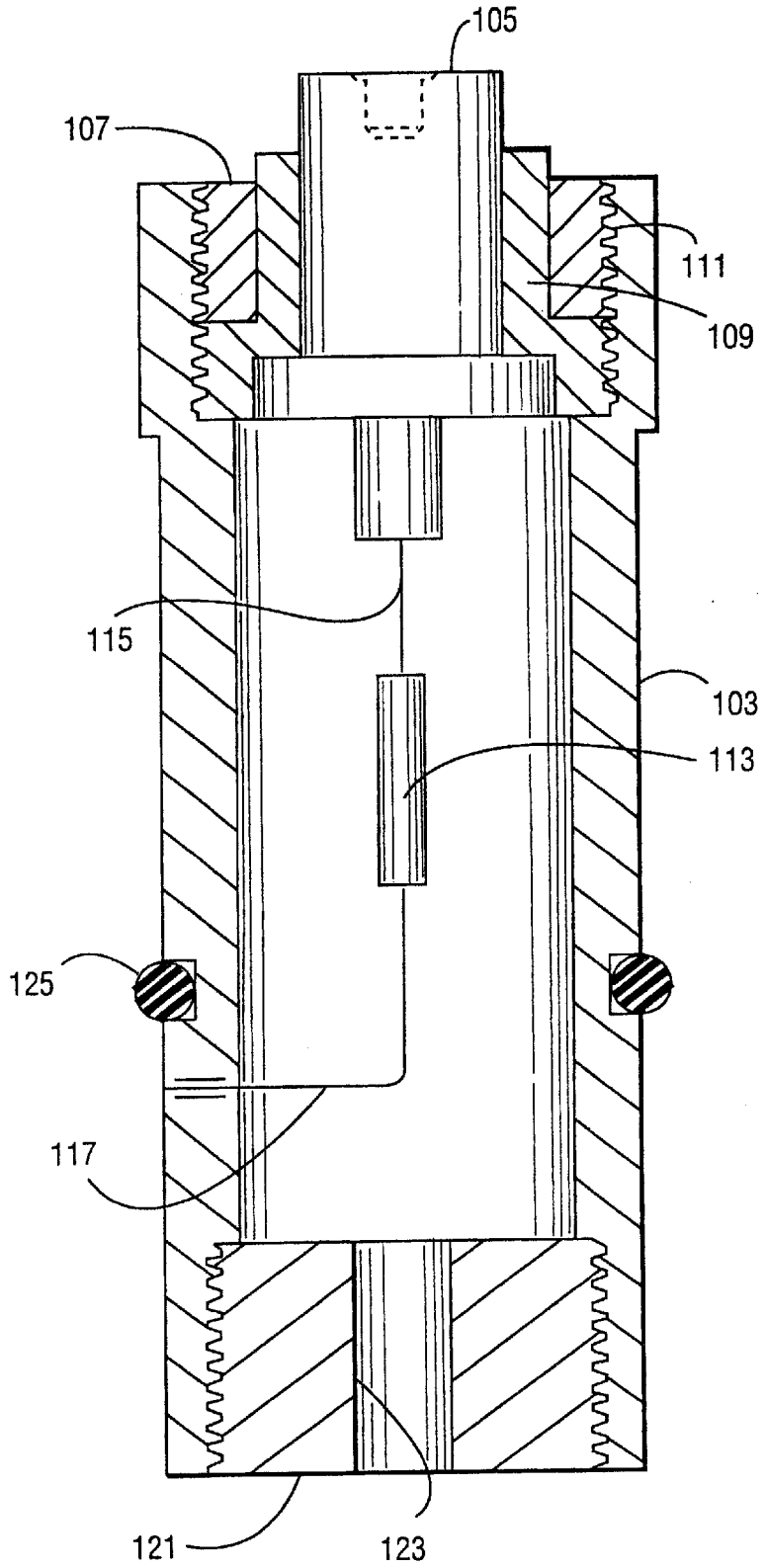
FIG. 9 is a cross-section of the thermal generator body of the apparatus.

The member 49 has a central opening 49(O) formed therethrough. A thermal generator 101 is located in the opening 49(O) next to the upper pellet 71. Referring also to FIG. 9, the generator 101 comprises an annular metal body 103 with an opening 103(O) formed therethrough. An electrical contact 105 is supported at its upper end which is supported by a threaded insulator 107 and a threaded ring

109 both of which are screwed to threads 111 formed in the wall of the member 103 at its upper end. The contact 105 is electrically connected to a electrical resistive member 113 by an electrical lead 115. The other end of the resistor 113 is connected to an electrical lead 117 which extends through the wall 103. The contact 105 is connected to a contact located in annular member 119. The contact in member 119 and lead 117 are connected to wires 63 and 67 by way of the assembly 51. The body 103 has a threaded bottom port plug 121 having threads which are screwed to threads formed in the wall of member 103 at its lower end. The plug 121 has a central 123 opening formed therethrough for the passage of heat for igniting the material 75 and pellets 71. Member 125 is an O-ring.

The support 81 is formed of carbon and has an annular shoulder 131 to support the pellets. The support 81 has a thin annular upper wall 133 that extends down to the annular shoulder 131 which has a central opening 135 formed therethrough. The lowest pellet 71 is supported by the shoulder 131 with the other pellets 71 stacked on top of each other. The lower edge of the shoulder 131 flares downward and outwards at 137 to a lower edge 139 which is supported by the upper end of a shield 161. The support 81 acts as a spacer which spaces the pellets 71 from the lower components and defines a mixing cavity 153 between upper and lower planes 153U and 153L and which is in the form of a truncated cone having a cone shaped side wall 137.

The lower components of the tool comprises a carbon shield 161, a metal nozzle 201, a carbon retainer 221, and a carbon diverter 231.

The shield 161 has an annular upper wall 183 with an upper end 185 that supports the lower edge 139 of the member 81. It extends down to an annular flat upper wall 187 from which an upward extending cone 189 extends. The shield 161 has a flat lower end 191. A plurality of spaced apart apertures 193 are formed through the wall portion 187 and end 191 around the axis of the cone 189 and the axis of the tool.

The nozzle 201 has a plurality of apertures 203 formed therethrough which are lined with carbon tubes 205 having a plurality of apertures 207. Each apertures 207 is aligned with an aperture 193. The nozzle 201 has a shaft 209 fixedly coupled thereto which extends downward from its lower surface 211. The shaft 209 has threads 213 at its lower end.

A carbon retainer 221 has a central aperture 223 formed therethrough and a plurality of spaced apart apertures 225 formed therethrough with each aperture 223 aligned with an apertures 207, such that a plurality of sets of aligned apertures 193, 207, 225 are formed. The retainer 221 has a lower outer annular wall 227 which extends downward to the lower level of the wall 43 such that the end 227E of the wall 227 forms a plane with the lower end 43E of the wall 43.

The diverter 231 has a surface 233 which flares and curves downward and outward from a small annular circumference at 235 to a larger annular circumference at 237 defining half of a hyperboloid.

The wall 227, the diverter surface 233 and the lower wall 227 of the retainer 221 form an annular chamber or cavity 241 into which hot gases from the nozzle apertures flow. The chamber 241 has an annular outlet gap 243.

The diverter 231 also has a central aperture 245. The nozzle shaft 209 extends through the diverter aperture 245 and is screwed to an anchor connector 247 having a wide annular shaped upper end 249. The lower end 251 of the diverter 231 abuts against the upper end 253 of the anchor connector 247. The shaft 209 is screwed into an aperture 251 of the anchor connector 247 and holds the diverter 231 in place.

Figure 3:
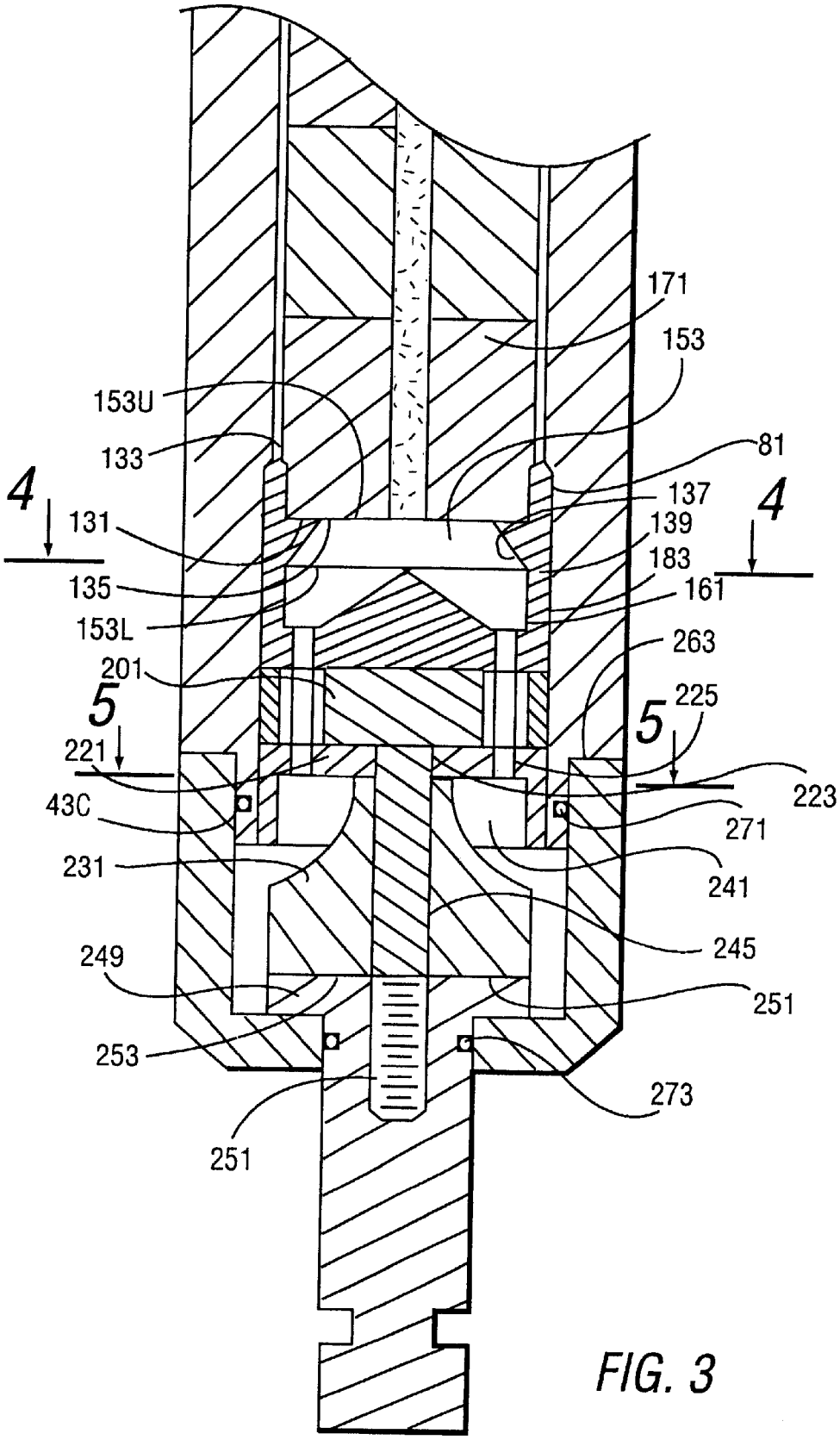
FIG. 3 is a cross-section of the lower end of the apparatus of FIGS. 1 and 2A and 2B.
Figure 4:
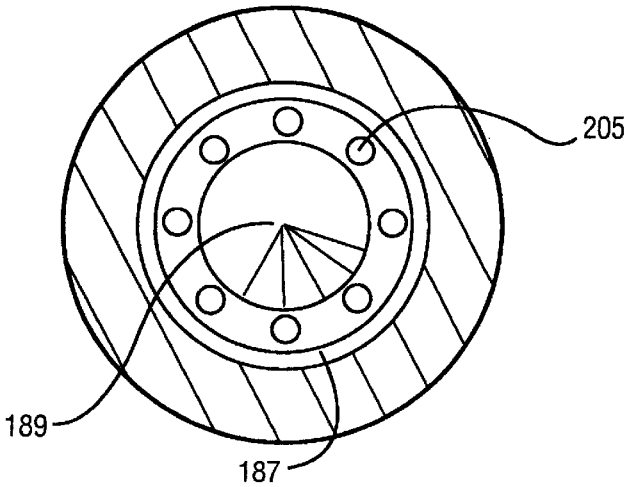
FIG. 4 is a view of FIG. 3 as seen along lines 4—4 thereof.
Figure 7:
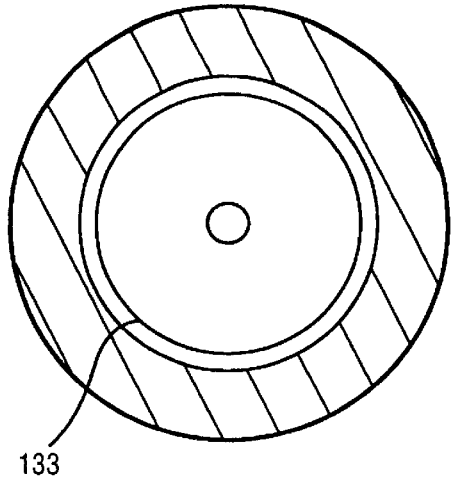
FIG. 7 is a view of FIG. 6 as seen along lines 7—7 thereof.
Figure 5:
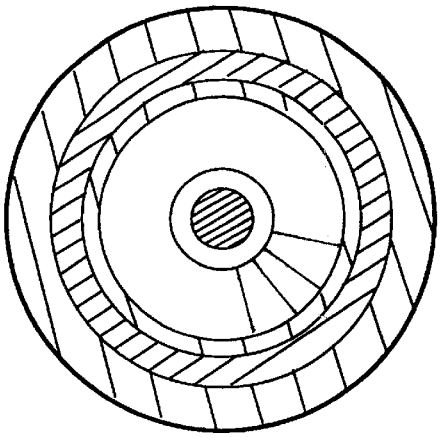
FIG. 5 is a view of FIG. 3 as seen along lines a 5—5 thereof.
Figure 8:
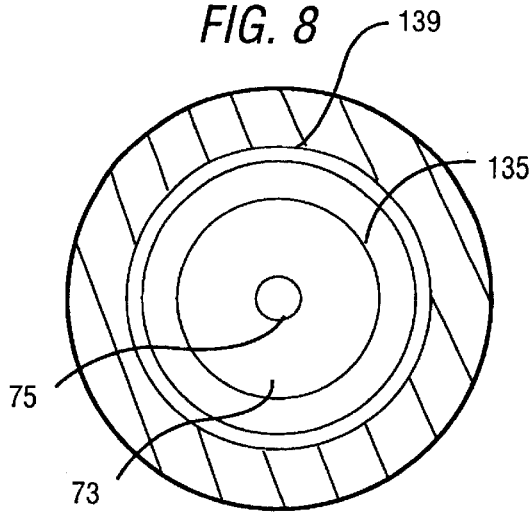
FIG. 8 is a view of FIG. 6 as seen along lines 8—8 thereof.
Figure 6:
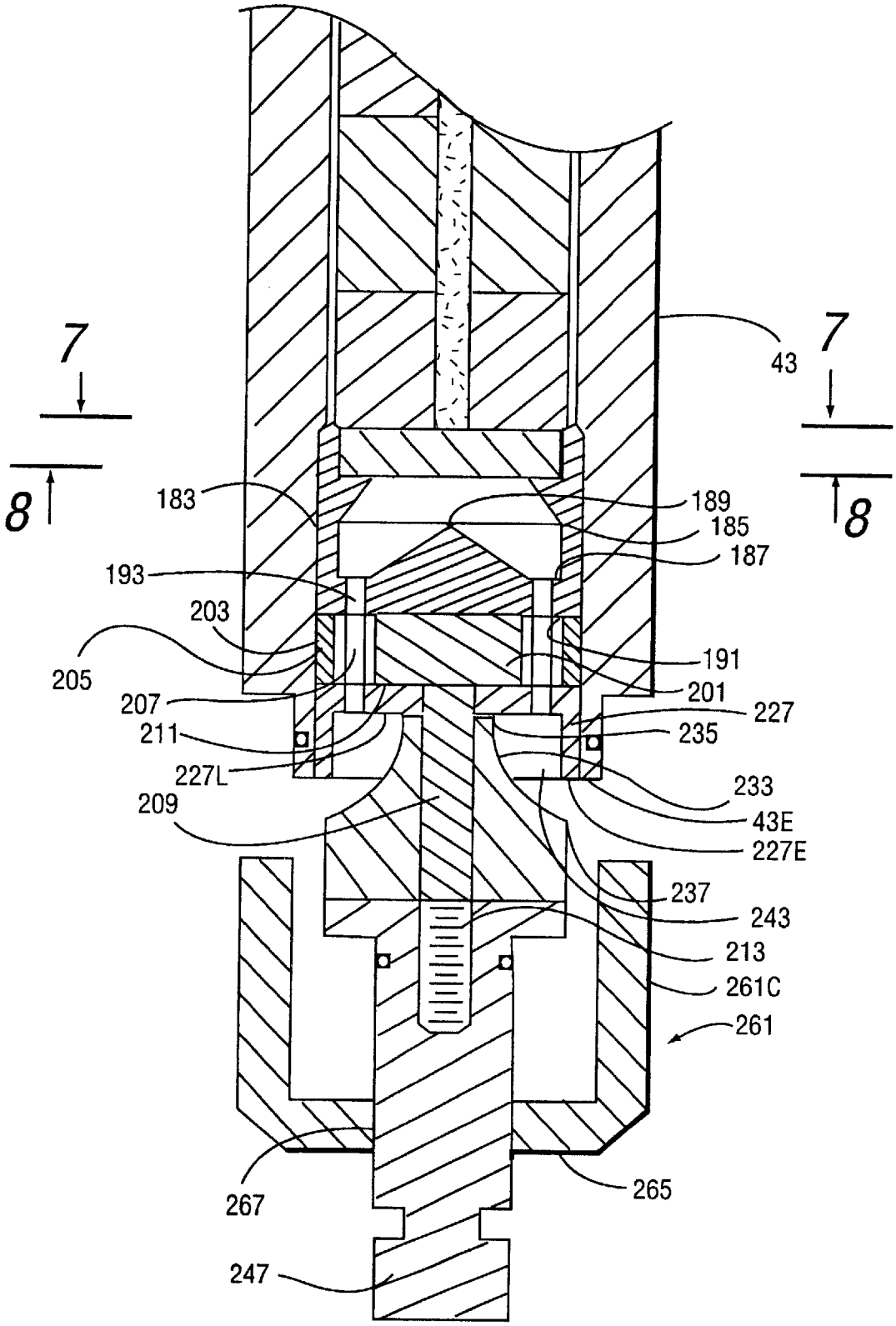
FIG. 6 is a cross-section of the lower end of the apparatus of FIGS. 1, 2A, and 2B with the sleeve in an open position.

Also provided is a metal sleeve 261 which is initially located in an upper closed position as shown in FIG. 3 and is movable by the hot gases to an open position as shown in FIG. 6. The cylindrical wall 43 has an inward extending shoulder 263 which extends to a smaller cylindrical surface 43C. The sleeve 261 comprises a cylindrical portion 261C. In the closed position, the upper end of the cylindrical portion 261C fits against the shoulder 263 and the surface 43C. The lower end of the sleeve 261 has an inward extending portion 265 with a circular aperture 267 formed therethrough through which the anchor connector 247 extends. Members 271 and 273 are O-rings.

In the operation of the system, the uphole switch 67 is closed to apply an electrical output to the resistor 113 which generates enough heat to ignite the combustible material 75 and pellets 71 which generate a flame and hot gases which flow through the plurality of openings 135 of the support 81 into the chamber or cavity 153 which promotes mixing of the gases prior to flow through the aligned hole sets 193, 207, 225. This prevents the hole sets 193, 207, 225 from becoming plugged. The flame and hot gases then flow out of the hole sets 193, 207, 225 into the annular cavity 241 formed between diverter surface 231, the bottom side of the retainer 221 and the inside of wall 227 and then out of the gap 243 formed between the ends 227E and 41E of the walls 227 and 41 and the large circumferential edge 237 of the diverter. The flame and hot gases push the sleeve 261 downward to a lower open position allowing the flame and hot gases flow out of the gap 243 formed between the diverter edge 237 and the ends 227E and 43E of the walls 27 and 43 radially outward to cut the pipe or tubing in the borehole. In the cavity 241, the pressure of the flame and hot gases builds up before leaving the gap 243 resulting in a more even distribution of the hot gases around the circumference of the diverter edge which results in a more even severing of the pipe or tubing in the borehole around its circumference.

Figure 10:
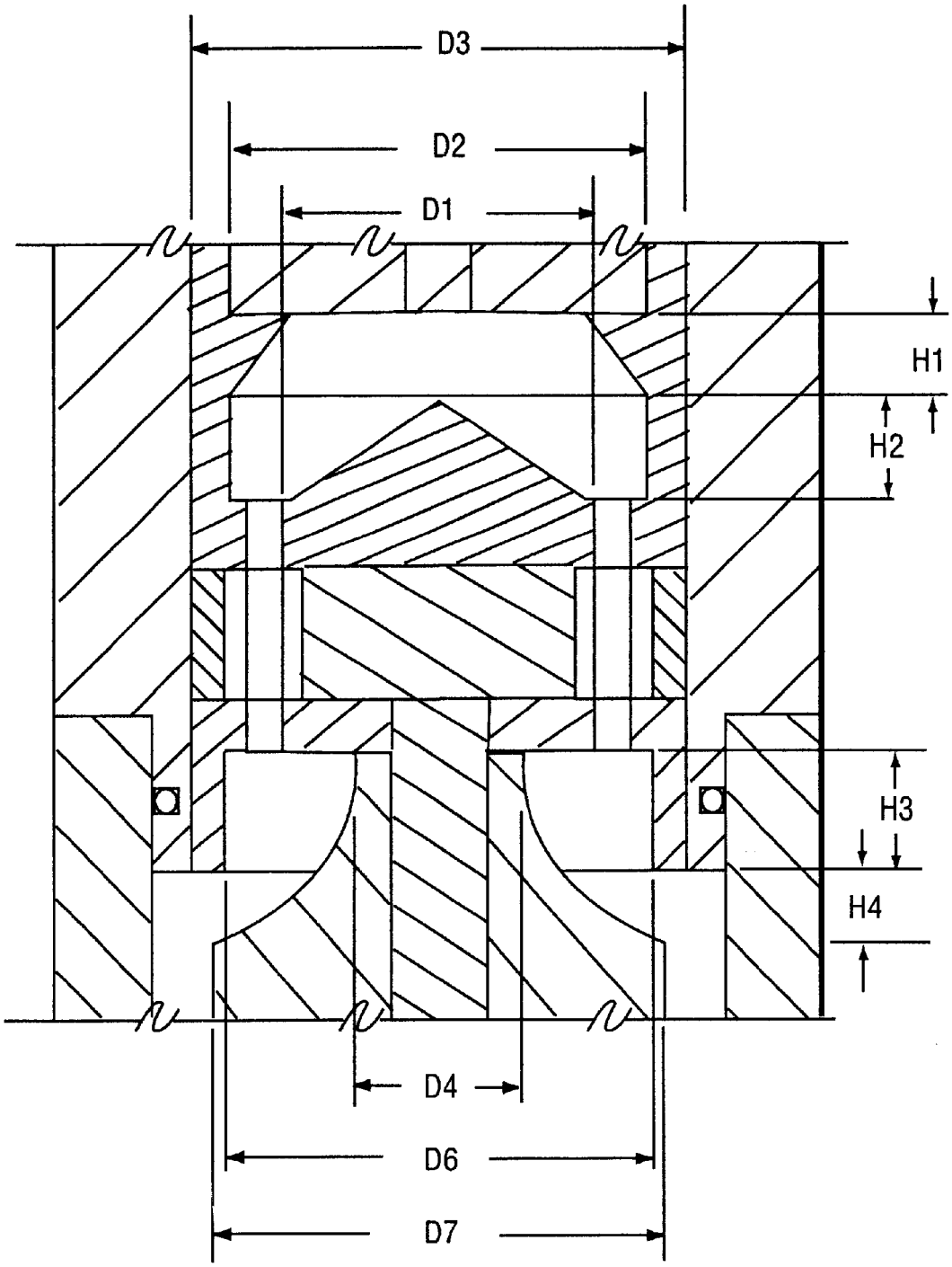
FIG. 10 is a partial cross-section of the apparatus similar to that of a portion of FIGS. 3 and 6.

Eight hole sets 193, 207, 225 are shown, however, the number of hole sets may vary from 6 to 24 or more. In one embodiment, for severing a pipe or tube having an inside diameter of 2⅜ inches, the outside diameter of the tool 21 may be 1½ inches. In this embodiment, and referring to FIG. 10, the diameters of D1, D2, D3, D4, D6, and D7, may be ⅝, 1, 1⅛, ⅝, 1, 1 7/16 inches respectively, and the heights H1, H2, H3, and H4 may be ⅜, ¼, ⅜, ⅛ inches respectively.

The height H4 of the gap 243 may be increased or decreased by using diverter 231 having a different curved surface 233.

What is claimed is:

1. An apparatus for cutting a conduit located in a borehole extending into the earth form the surface, comprising:

an elongated body having an opening extending between an ignition end and a nozzle end with said body being adapted to be lowered into the conduit to be cut with said nozzle end located below said ignition end, said opening of said body comprises an opening having a central axis, combustible material located in said opening of said body, spacer means having a support surface and a lower end for supporting said combustible material in said opening of said body, said spacer means having an opening formed through said support surface, a nozzle and a diverter located at said nozzle end adjacent said spacer means with said nozzle located between said spacer means and said diverter and with said nozzle spaced from said spacer means, said spacer means having a surrounding surface formed between said opening of said support surface and said lower end forming an unobstructed mixing cavity within said surrounding surface above said nozzle, said cavity is defined at least by spaced apart planar boundaries and a surrounding wall located below said support surface and above a shield, said diverter comprising a surface which curves outward from a smaller circumference located near said nozzle to a larger circumference spaced away from said nozzle, ignition means located at said ignition end for igniting said combustible material to form a flame for passage toward said nozzle by way of said mixing cavity, said nozzle comprising a plurality of spaced apart apertures formed therethrough for directing the flame from said mixing cavity to said surface of said diverter for directing the flame radially outward of said body for cutting the conduit in the borehole, said apertures of said nozzle extend through said nozzle generally around and parallel to said central axis, said body at said nozzle end comprises a surrounding wall which extends to a position between said smaller circumference and said larger circumferences of said surface of said diverter such that said surrounding wall and said surface of said diverter within said surrounding wall form a second cavity for pressurizing the hot gases that flow from said apertures of said nozzle before leaving said body, said smaller circumference of said surface of said diverter is located radially inward of said apertures an amount greater than the radial distance of said apertures from said surrounding wall.

2. The apparatus of claim 1, wherein:

said surrounding wall extends to a position greater than half of the axial distance between said smaller and larger circumferences.

3. An apparatus for cutting a conduit located in a borehole extending into the earth form the surface, comprising:

an elongated body having an opening extending between an ignition end and a nozzle end with said body being adapted to be lowered into the conduit to be cut with said nozzle end located below said ignition end, said opening of said body comprises an opening having a central axis;

combustible material located in said opening of said body, spacer means having a support surface and a lower end for supporting said combustible material in said opening of said body, said spacer means having an opening formed through said support surface, a nozzle and a diverter located at said nozzle end adjacent said spacer means with said nozzle located between said spacer means and said diverter and with said nozzle spaced from said spacer means, said spacer means having a surrounding surface formed between said opening of said support surface and said lower end forming an unobstructed mixing cavity within said surrounding surface above said nozzle, said diverter comprising a surface which curves outward from a smaller circumference located near said nozzle to a larger circumference spaced away from said nozzle, ignition means located at said ignition end for igniting said combustible material to form a flame for passage toward said nozzle by way of said mixing cavity, said nozzle comprising a plurality of spaced apart apertures formed therethrough for directing the flame from said mixing cavity to said surface of said diverter for directing the flame radially outward of said body for cutting the conduit in the borehole, said apertures of said nozzle extend through said nozzle generally around and parallel to said central axis, said body at said nozzle end comprises a surrounding wall which extends to a position between said smaller circumference and said larger circumferences of said surface of said diverter such that said surrounding wall and said surface of said diverter within said surrounding wall form a second cavity for pressurizing the hot gases that flow from said apertures of said nozzle before leaving said body, said surrounding wall extends to a position greater than half of the axial distance between said smaller and larger circumferences.

4. An apparatus for cutting a conduit located in a borehole extending into the earth from the surface, comprising:

an elongated body having an opening extending between an ignition end and a nozzle end with said body being adapted to be lowered into the conduit to be cut with said nozzle end located below said ignition end, solid combustible material located in said opening of said body, a nozzle and a diverter located at said nozzle end with said nozzle located between said combustible material and said diverter, said diverter comprising a surface which curves outward from a smaller circumference located near said nozzle to a larger circumference spaced away from said nozzle, there being a cavity around said curved surface, ignition means located at said ignition end for igniting said combustible material to form a flame for passage toward said nozzle, said nozzle comprising a plurality of spaced apart apertures formed therethrough, the apertures opening into the cavity, wherein the flame is directed to said surface of said diverter and radially outward through an exit for cutting the conduit in the borehole, said body at said nozzle end comprises a surrounding wall which extends to a position between said smaller circumference and said larger circumferences of said surface of said diverter such that said surrounding wall constricts the exit of said cavity for pressurizing the hot gases that flow from said apertures of said nozzle before leaving said cavity.

5. The apparatus of claim 4, wherein:

said smaller circumference of said surface of said diverter is located radially inward of said apertures an amount greater than the radial distance of said apertures from said surrounding wall.

6. The apparatus of claim 4, wherein:

said surrounding wall extends to a position greater than half of the axial distance between said smaller and larger circumferences.

7. The apparatus of claim 5, wherein:

said surrounding wall extends to a position greater than half of the axial distance between said smaller and larger circumferences.

8. An apparatus for cutting a conduit located in a borehole extending into the earth from the surface, comprising:

an elongated body having an opening extending between an ignition end and a nozzle end with said body being adapted to be lowered into the conduit to be cut with said nozzle end located below said ignition end, combustible material located in said opening of said body, a nozzle and a diverter located at said nozzle end with said diverter located below said nozzle, said diverter comprising a surface which curves outward from a smaller circumference located near said nozzle to a larger circumference spaced away from said nozzle, an annular shield located above said nozzle, spacer means separate from said shield having a support surface with an opening formed therethrough for supporting said combustible material at a position spaced from said shield and forming a mixing cavity between said support surface and said shield, ignition means located at said ignition end for igniting said combustible material to form a flame for passage toward said nozzle by way of said mixing cavity, said nozzle comprising a plurality of spaced apart apertures formed therethrough for directing the flame from said mixing cavity to said surface of said diverter for directing the flame radially outward of said body for cutting the conduit in the borehole.

9. The apparatus of claim 8, wherein:

said mixing cavity is defined at least by spaced apart planar boundaries and a surrounding wall located below said support surface and above said shield.

10. The apparatus of claim 8, wherein:

said opening of said body comprises an opening having a central axis, said apertures of said nozzle extend through said nozzle generally around and parallel to said central axis, said body at said nozzle end comprises a surrounding wall which extends to a position between said smaller circumference and said larger circumferences of said surface of said diverter such that said surrounding wall and said surface of said diverter within said surrounding wall form a second cavity for pressurizing the hot gases that flow from said apertures of said nozzle before leaving said body.

11. An apparatus for cutting a conduit located in a borehole, comprising:

an elongated body having a first end and a second end and an interior passage extending therebetween, the body being structured and arranged to be lowered into the conduit with the first end interposed between the second end and a surface of the earth, the first end being structured and arranged to receive an igniter, the second end comprising an outlet, combustible material located in the passage adjacent to the first end, a nozzle located in the passage, the nozzle comprising plural apertures that allow gases from the combustible material to pass into a cavity, each of the apertures having a first transverse cross-sectional area, the cavity being formed by a surface that directs the gases radially through the outlet, the cavity having a second transverse cross-sectional area where the apertures communicate with the cavity, the second transverse cross-sectional area being greater than the first transverse cross-sectional area, the outlet forming a restriction to the gases in the cavity flowing through the outlet.

12. The apparatus of claim 11, further comprising:

a mixing chamber interposed between the nozzle and the combustible material.

13. A method of cutting a conduit located in a borehole in the earth, comprising the steps of:

combusting a material to produce hot gases;

flowing the gases through a plurality of nozzle passages that are oriented with the borehole and are located in a circumferential manner relative to the conduit;

flowing the gases into a diverter cavity;

pressurizing the gases in the diverter cavity to allow a more even circumferential distribution and then radially flowing the gases through a circumferential exit in the diverter cavity toward the conduit.

14. The method of claim 13 further comprising the step of mixing the gases in a chamber before the step of flowing the gases through a plurality of nozzle passages.

15. The method of claim 13 wherein the step of flowing the gases into a diverter cavity further comprises the step of flowing the gases from the nozzle passages into the larger diverter cavity.

16. The method of claim 15 wherein the step of pressurizing the gases in the diverter cavity to allow a more even circumferential distribution and then radially flowing the gases through a circumferential exit further comprises the step of flowing the gases in the diverter cavity through a constricting exit.

* * * * *